US011326480B2

(12) United States Patent
Brune et al.

(10) Patent No.: US 11,326,480 B2
(45) Date of Patent: May 10, 2022

(54) ROCKER ARM ASSEMBLY

(71) Applicant: GT TECHNOLOGIES, INC., Westland, MI (US)

(72) Inventors: John E. Brune, Stockbridge, MI (US); Scott P. Smith, Temperance, MI (US); Dennis Landis, Toledo, OH (US)

(73) Assignee: GT TECHNOLOGIES, INC., Westland, MI (US)

( * ) Notice: Subject to any disclaimer, the term of this patent is extended or adjusted under 35 U.S.C. 154(b) by 0 days.

(21) Appl. No.: 17/371,240

(22) Filed: Jul. 9, 2021

(65) Prior Publication Data

US 2022/0010692 A1 Jan. 13, 2022

Related U.S. Application Data

(60) Provisional application No. 63/049,834, filed on Jul. 9, 2020.

(51) Int. Cl.
*F01L 1/18* (2006.01)
*F01L 1/14* (2006.01)

(52) U.S. Cl.
CPC ..... *F01L 1/18* (2013.01); *F01L 1/181* (2013.01); *F01L 1/182* (2013.01); *F01L 1/146* (2013.01); *F01L 2305/02* (2020.05)

(58) Field of Classification Search
CPC . F01L 1/146; F01L 1/181; F01L 1/182; F01L 1/183; F01L 1/46; F01L 2305/02
USPC ..... 123/90.39, 90.41
See application file for complete search history.

(56) References Cited

U.S. PATENT DOCUMENTS 4,858,575 A * 8/1989 Fittro ..... F01L 1/183 123/90.41
4,944,257 A 7/1990 Mills
5,027,191 A 6/1991 Bourdelaise et al.
5,063,889 A 11/1991 Pryba et al.
5,074,261 A * 12/1991 Hamburg ..... F01L 1/182 74/519
5,313,916 A * 5/1994 Murphy ..... F16C 33/588 74/519

(Continued)

FOREIGN PATENT DOCUMENTS

JP H09125917 A 5/1997
JP 2016125348 A 7/2016

OTHER PUBLICATIONS

International Search Report and Written Opinion of the International Searching Authority for PCT International Application No. PCT/US2021/040983 dated Oct. 27, 2021.

*Primary Examiner* — Jorge L Leon, Jr.
(74) *Attorney, Agent, or Firm* — Howard & Howard Attorneys PLLC

(57) ABSTRACT

A rocker arm assembly including a rocker body having an upper wall arranged above a pivot axis, two ears extending from opposing sides of the upper wall and defining a pivot bore coaxial with the pivot axis, and a pad end wall and a socket end wall each extending from the upper wall and the ears. A pad having a convex pad surface is formed on the pad end wall for engaging a valve and a socket having a concave socket surface is formed on the socket end wall for engaging a pushrod. The rocker arm assembly further includes a trunnion body and a bearing, each disposed in the pivot bores and for facilitating pivoting movement between the rocker body and the trunnion body.

18 Claims, 10 Drawing Sheets

(56) References Cited

U.S. PATENT DOCUMENTS

| | | | | |
|---|---|---|---|---|
| 5,433,178 | A * | 7/1995 | Urmaza | F01L 1/182 74/519 |
| 5,437,209 | A * | 8/1995 | Santoro | F01L 1/183 74/519 |
| 6,227,156 | B1 | 5/2001 | Autrey et al. | |
| 6,293,168 | B1 * | 9/2001 | Torlai | F01L 1/18 74/559 |
| 6,612,199 | B2 | 9/2003 | Cutshall et al. | |
| 7,185,618 | B1 | 3/2007 | Edelmayer | |
| 8,573,170 | B2 | 11/2013 | Sullivan et al. | |
| 2003/0140878 | A1 * | 7/2003 | Stallmann | F01L 1/181 123/90.41 |
| 2008/0098971 | A1 * | 5/2008 | Baker | F01L 1/182 123/90.41 |
| 2009/0000583 | A1 * | 1/2009 | Baynes | F16C 33/585 384/91 |
| 2012/0060781 | A1 * | 3/2012 | Sullivan | F01L 1/182 123/90.39 |
| 2017/0350281 | A1 | 12/2017 | Yamane et al. | |
| 2018/0216501 | A1 * | 8/2018 | Brown | F01L 1/181 |

* cited by examiner

FIG. 14
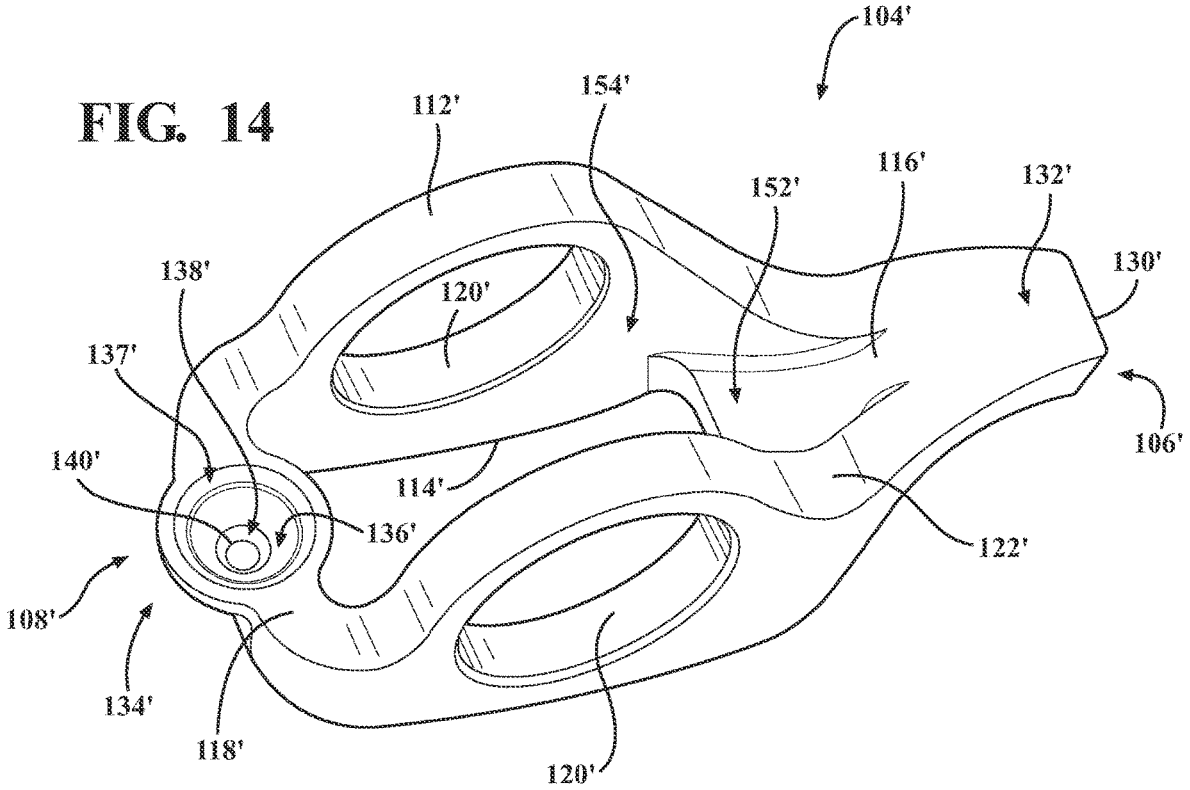
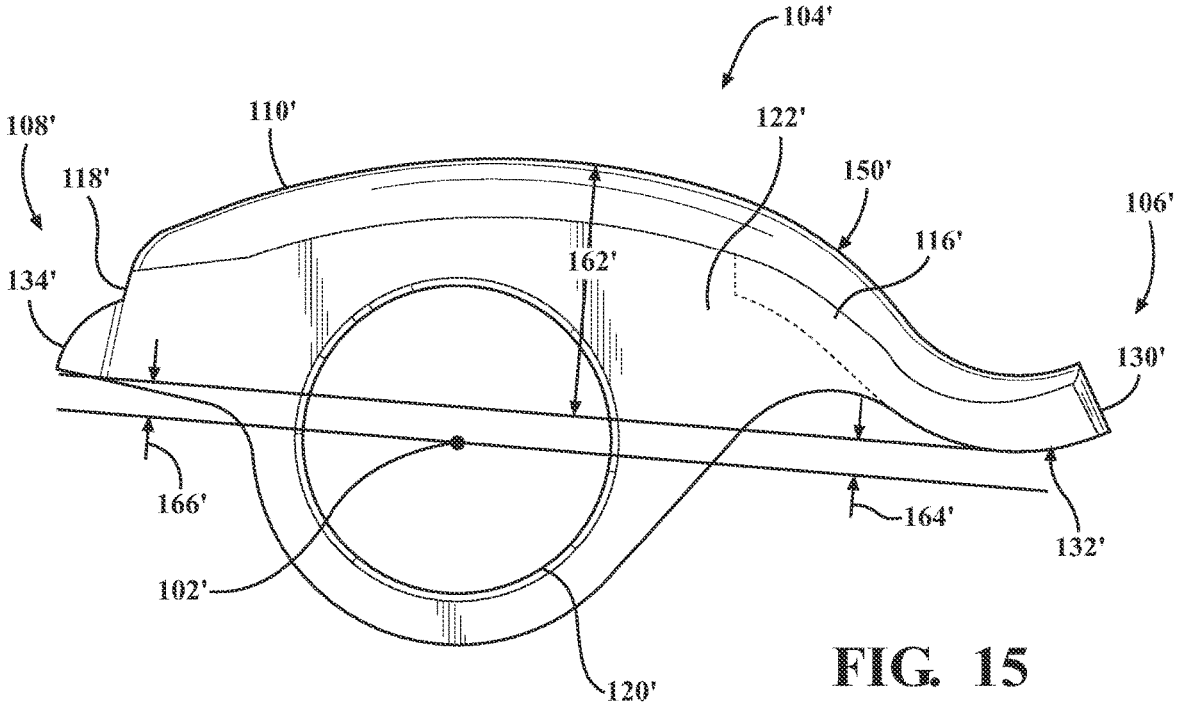
FIG. 15

ROCKER ARM ASSEMBLY

CROSS-REFERENCE TO RELATED APPLICATIONS

The subject patent application claims priority to and all the benefits of U.S. Provisional Patent Application No. 63/049,834, filed on 9 Jul. 2020, the entire contents of which are incorporated by reference herein.

BACKGROUND

1. Field of the Invention

The present invention relates, generally, to engine valvetrain systems and, more specifically, to a rocker arm assembly for use in a valvetrain of a cylinder head of an internal combustion engine.

2. Description of the Related Art

Conventional engine valvetrain systems known in the art typically include one or more camshafts in rotational communication with a crankshaft supported in a block, one or more intake and exhaust valves supported in a cylinder head, and one or more intermediate members for transforming rotational motion of lobes on the camshaft into linear motion of the valves. The valves are used to regulate flow through respective intake and exhaust ports defined in the cylinder head and in fluid communication with a combustion chamber. To that end, the valves each have a head configured to seal against a valve seat in the cylinder head, and a stem extending therefrom. The valve stem is typically supported for linear motion by a valve guide, which is attached to the cylinder head such that the valve stem extends through the valve guide and travels therealong in response to engagement from the intermediate member. A compression spring is typically disposed about the valve stem and arranged between the cylinder head and a spring retainer operatively coupled to the valve stem. The spring provides a force that urges the valve toward a closed position.

One engine configuration, particularly popular in V-engines, is known as "cam-in-block", in which the camshaft is supported in the block. Oftentimes, cam-in-block engines utilize an "overhead valve" (OHV) arrangement, in which the valves are arranged above (i.e. overhead) the combustion chamber. In order to translate the force from the camshaft to the valve stem above the combustion chamber, the intermediate member may include a cam follower, a pushrod, and a rocker arm. The cam follower, commonly referred to as a lifter, engages the camshaft lobe and moves in a linear path according to a profile of the camshaft lobe. Motion of the cam follower is transferred through the pushrod to the rocker arm, which is supported on the cylinder head. The rocker arm extends between and engages the pushrod and the valve stem.

As the camshaft rotates, the intermediate member transforms rotation from the lobes into linear movement of the valve between two different positions, commonly referred to as "valve opened" and "valve closed". In the valve closed position, potential energy from the loaded spring holds the valve head sealed against the valve seat. In the valve opened position, the intermediate member transforms the linear movement to compress the spring, thereby un-sealing the valve head from the valve seat so as to allow gasses to flow into, or out of, the combustion chamber.

Each of the components of an engine valvetrain system of the type described above must cooperate to effectively transform movement from the camshaft so as to operate the valves properly at a variety of engine rotational speeds and operating temperatures. In addition, each of the components must be designed not only to facilitate improved performance and efficiency, but also so as to reduce the cost and complexity of manufacturing and assembling the valvetrain system, as well as reduce wear in operation. While engine valvetrain systems known in the related art have generally performed well for their intended purpose, there remains a need in the art for an engine valvetrain system that has superior operational characteristics, and, at the same time, reduces the cost and complexity of manufacturing the components of the system.

SUMMARY

The present invention is directed toward a rocker arm assembly comprising a rocker body having a socket end longitudinally spaced relative to a pad end and on opposite sides of a pivot axis. The rocker body includes an upper wall arranged above the pivot axis and defining an aperture, two ears each extending from an opposing side of the upper wall and defining a pivot bore extending therethrough and coaxial to the pivot axis. The rocker body further includes a pad end wall and a socket end wall each extending from the upper wall and both of the ears. A pad is formed on the pad end wall and has a pad surface oriented away from the upper wall for engaging a valve stem. A socket is formed on the socket end wall has a socket surface opening away from the upper wall for engaging a pushrod. The rocker arm assembly further includes a trunnion body and a bearing. The trunnion body is disposed in each of the pivot bores and defines a mounting bore configured for receiving a fastener. The bearing is supported on the trunnion body and is disposed in each of the pivot bores for facilitating pivoting movement between the rocker body and the trunnion body.

BRIEF DESCRIPTION OF THE DRAWINGS

Advantages of the present disclosure will be readily appreciated as the same becomes better understood by reference to the following detailed description when considered in connection with the accompanying drawings.

FIG. 14 is a bottom perspective view of the rocker body of FIG. 13.

FIG. 15 is a side view of the rocker body of FIG. 14.

DETAILED DESCRIPTION

Figure 1:
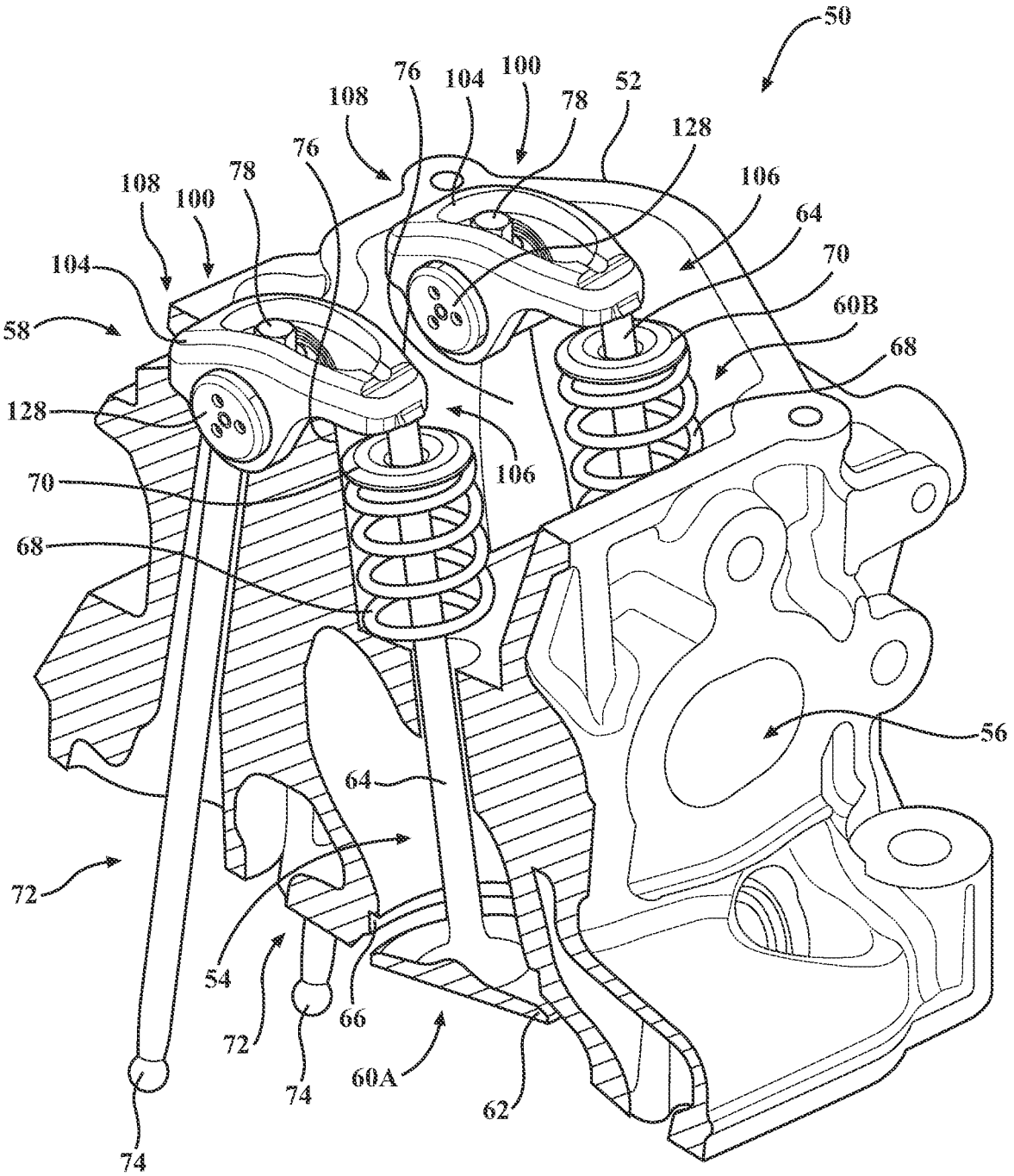
FIG. 1 is a partially cross-sectional perspective view of a cylinder head and valve train for an internal combustion engine.

With reference to the Figures, wherein like numerals indicate like parts throughout the several views, a portion of a cylinder head assembly, for use with an internal combustion engine, is illustrated at 50 in FIG. 1. The cylinder head assembly 50 includes a cylinder head 52, generally formed from a cast metal such as aluminum or iron, which defines one or more intake ports 54 and one or more exhaust ports 56 that route combustion products into and out of a combustion chamber. In order to regulate the flow of combustion products through the intake and exhaust ports 54, 56 the cylinder head assembly 50 further comprises a valvetrain, generally indicated at 58, which typically includes one or more camshafts (not shown) in rotational communication with a crankshaft supported in a cylinder block, one or more intake valves 60A and one or more exhaust valves 60B supported in the cylinder head 52, and one or more intermediate members for transforming rotational motion of lobes on the camshaft into linear motion of the valves 60A, 60B. To that end, the valves 60A, 60B each have a head 62 and a stem 64 extending therefrom. The head 62 is configured to seal against a valve seat 66 in the cylinder head 52, and the stem 64 is supported for linear motion by a valve guide (not shown) attached to the cylinder head 52 such that the valve stem 64 extends through the valve guide and travels therealong in response to engagement from the intermediate member. A valve spring 68 is typically disposed about the valve stem 64 and arranged between the cylinder head 52 and a spring retainer 70 operatively coupled to the valve stem 64. The spring 68 provides a force that urges the valve 60 toward a closed position.

More specifically, the one or more intermediate members that cooperate with the camshaft may include a lifter (not shown) in contact with the camshaft lobe, a pushrod 72, and a rocker arm assembly 100. The rocker arm assembly 100 is supported on a pedestal 76 formed in the cylinder head 52 and coupled thereto with a fastener 78. FIG. 1 shows the rocker arm assembly 100 oriented in an installed position in the cylinder head 52. The pushrod 72 has two ball ends 74 and is arranged between the rocker arm assembly 100 and the lifter to effect pivoting movement of the rocker arm assembly 100 that actuates the valve 60. The rocker arm assembly 100 cooperates with the valve 60, the pushrod 72, the lifter, and the camshaft lobe to regulate the flow of combustion products into and out of the combustion chamber during operation of the internal combustion engine.

Figure 2:
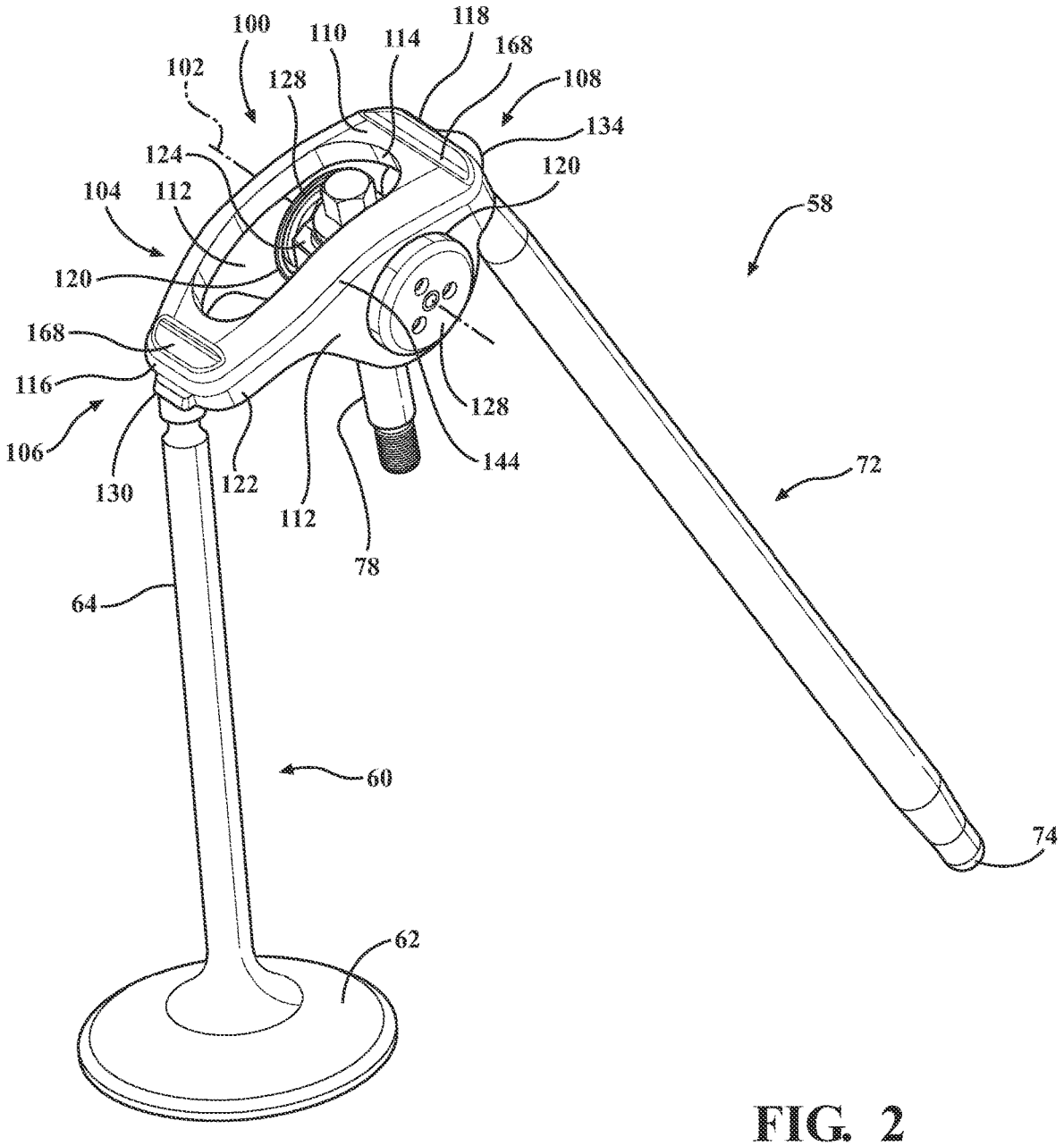
FIG. 2 is a perspective view of the valvetrain of FIG. 1 including a rocker arm assembly, a valve, and a pushrod.
Figure 4:
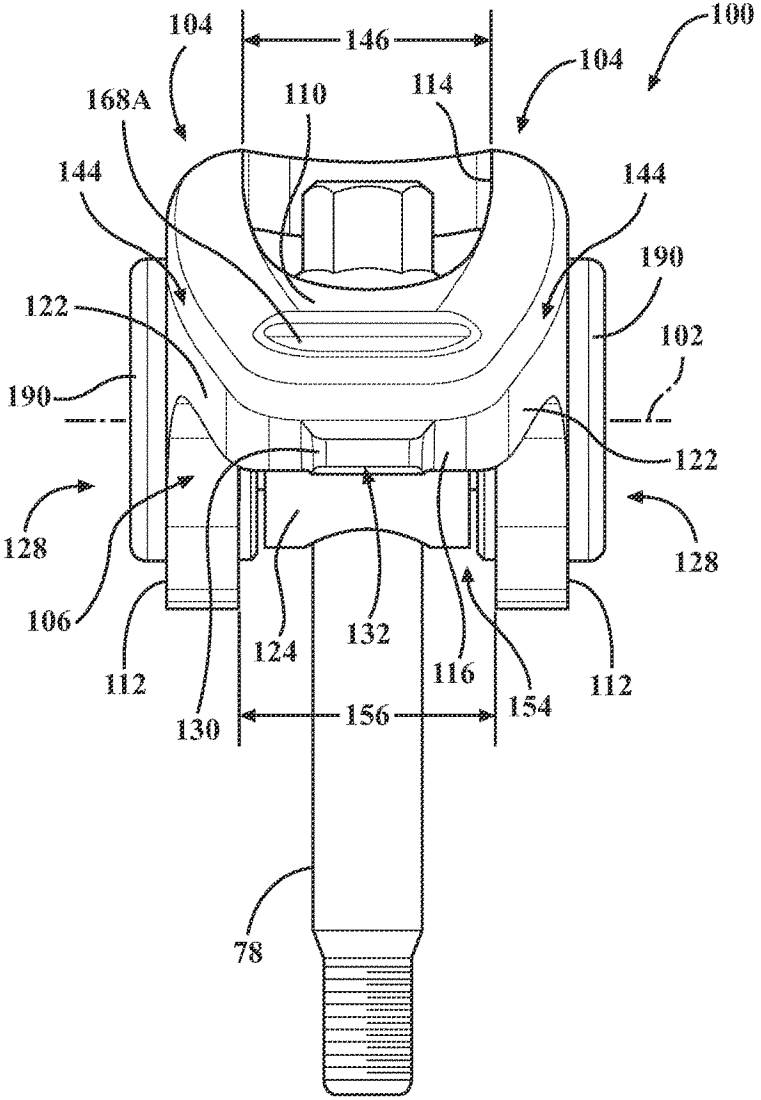
FIG. 4 is a front view of the rocker arm assembly of FIG. 3.
Figure 3:
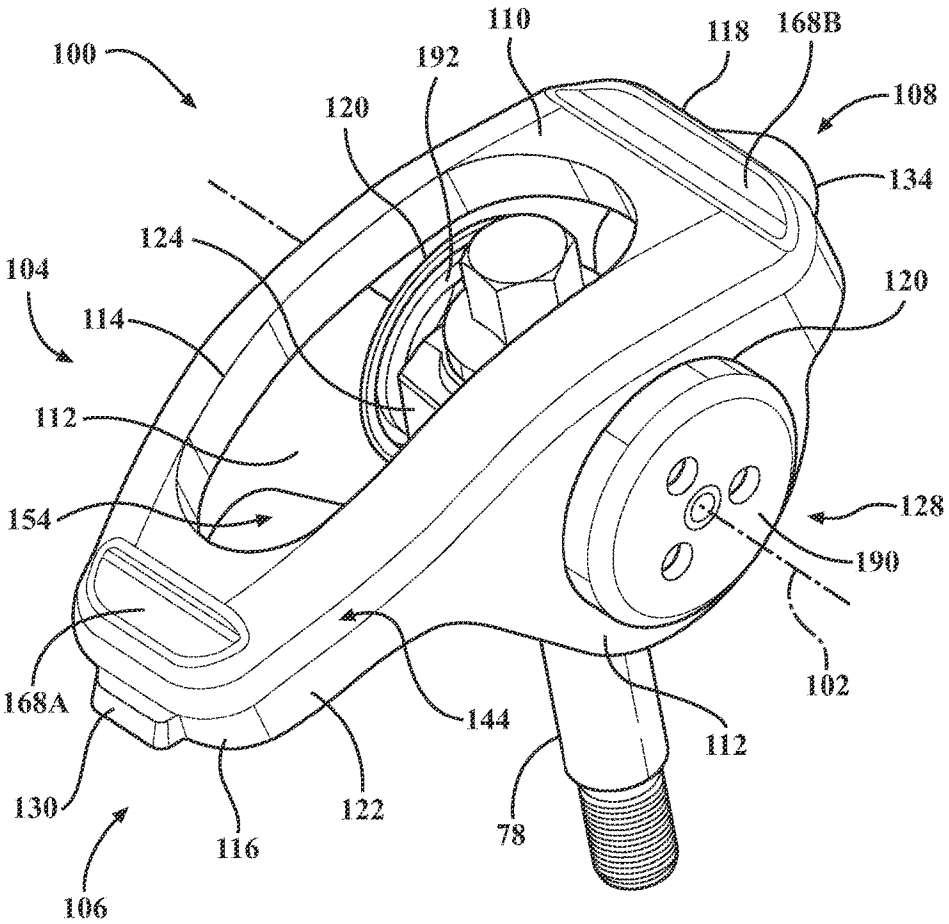
FIG. 3 is a perspective view of the rocker arm assembly of FIG. 2.

Turning now to FIG. 2, a portion of the valvetrain 58 is shown, specifically, the rocker arm assembly 100, the pushrod 72, the valve 60, and the fastener 78. The rocker arm assembly 100 defines a pivot axis 102 about which the rocker arm assembly 100 pivots in response to forces from the valve 60 and the pushrod 72. Force from the lobe of the camshaft displaces the pushrod 72 toward the rocker arm assembly 100, which causes the rocker arm assembly 100 to pivot. Pivoting of the rocker arm assembly 100 displaces the valve 60, which compresses the spring 68 (FIG. 1). As the combustion cycle continues a valve closing event is reached, where force from the spring 68 acts toward the rocker arm assembly 100 to close the valve 60, which pivots the rocker arm assembly 100 and displaces the pushrod 72 toward the lobe of the camshaft.

The rocker arm assembly 100 comprises a rocker body 104 having a pad end 106 and a socket end 108. The socket end 108 is spaced in a longitudinal direction relative to the pad end 106 such that the socket end 108 and the pad end 106 are on opposite sides of the pivot axis 102. The arrangement of the pad end 106 and the socket end 108 across the pivot axis 102 is such that movement of one end results in coordinated movement of the other, e.g. as the socket end 108 moves in an upward direction the pad end 106 moves in a downward direction, and vice versa. In some embodiments the pad end 106 and the socket end 108 are spaced equally from the pivot axis 102 such that there is a one to one ratio in displacement of the pushrod 72 and the valve 60. In the embodiment shown in FIGS. 2-9, the pad end 106 is spaced from the pivot axis 102 at a greater distance than the socket end 108 is spaced from the pivot axis 102. Specifically, FIG. 7 shows the pad end 106 spaced such that the ratio of displacement of the valve 60 to displacement of the pushrod is greater than one to one, e.g. 1.5:1.

Figure 5:
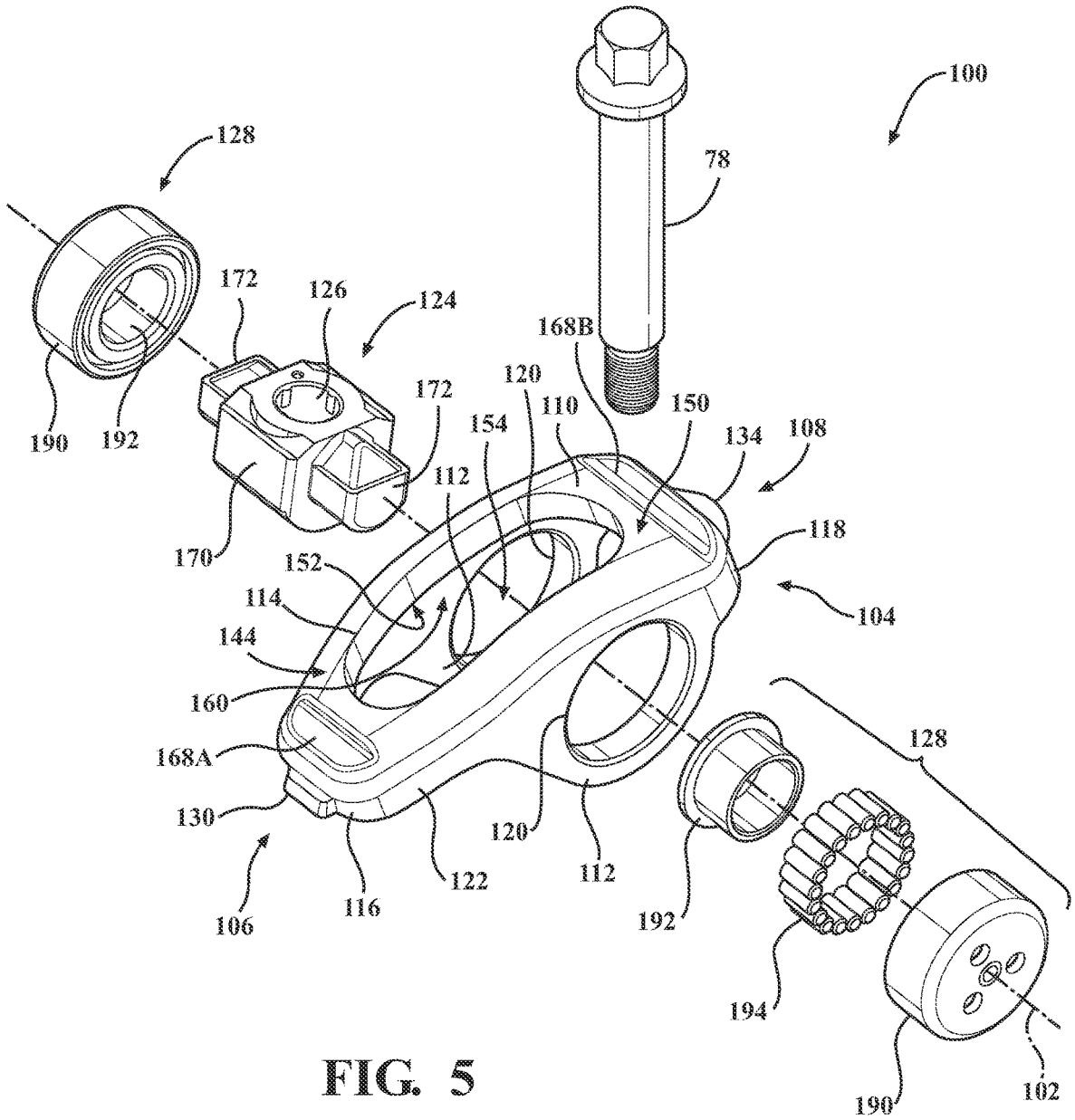
FIG. 5 is an exploded view of the rocker arm assembly of FIG. 3 including a rocker body, a trunnion body, a bearing, and a fastener.

Best shown in FIG. 5, the rocker body 104 generally includes an upper wall 110 and two ears 112. The upper wall 110 is arranged above the pivot axis 102 and defines an aperture 114 extending therethrough. The ears 112 each extend generally downward from laterally opposing sides of the upper wall 110 when the rocker arm assembly 100 is oriented in an installed position. In some configurations, the ears 112 may be angled away from perpendicular relative to the pivot axis 102. Each ear 112 defines a pivot bore 120 that is coaxial with the pivot axis 102. Each pivot bore 120 extends through the respective ear 112 and shares a common diameter with the pivot bore 120 on the opposing ear 112. When the rocker body 104 is configured with ears 112 that are angled relative to the pivot axis 102, the pivot bore 120 may have an oblong contact pattern with a bearing assembly disposed in the pivot bore 120.

The rocker body 104 may further include a pad end wall portion 116 and a socket end wall portion 118 arranged as the respective pad end 106 and socket end 108. The pad end wall portion 116 and the socket end wall portion 118 each extend downwardly from longitudinally opposing ends of the upper wall 110. In some embodiments, the pad end wall portion 116 and the socket end wall portion 118 may be portions of the upper wall 110 sharing one or more continuous surfaces. Alternatively, the pad end wall portion 116 and the socket end wall portion 118 may be referred to as a pad end wall 116 and a socket end wall 118.

Figure 6:
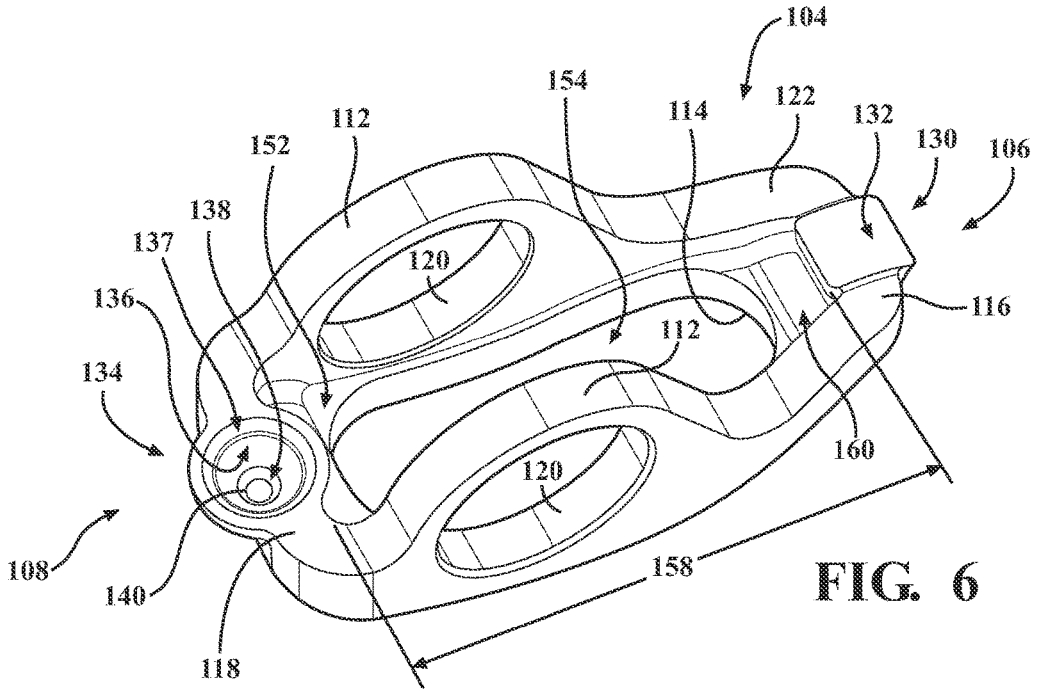
FIG. 6 is a bottom perspective view of the rocker body of FIG. 5.
Figure 7:
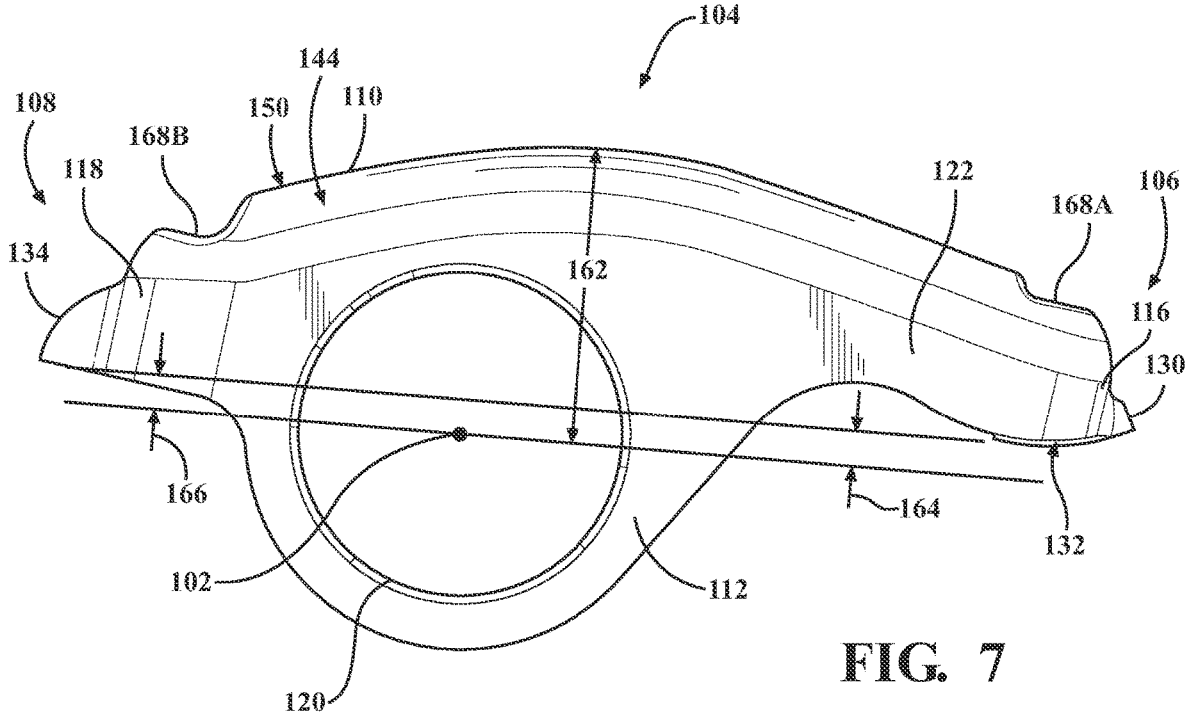
FIG. 7 is a side view of the rocker body of FIG. 6.

As shown in FIG. 6, the pad end wall portion 116 and the socket end wall portion 118 may further extend between the ears 112 on the lateral sides of the upper wall 110. More specifically, the pad end wall portion 116 and the socket end wall portion 118 cooperate with the ears 112 to define a perimeter wall 122. As with the ears 112 and end walls 116, 118, the perimeter wall 122 extends downwardly from a periphery of the upper wall 110. The upper wall 110 and the perimeter wall 122 may be integrally formed with various general shapes. Here, the upper wall 110 is generally rectangular and the perimeter wall 122 is formed on each of the four sides. Furthermore, the delineation between the upper wall 110 and the perimeter wall 122 may vary. For example, the rocker body 104 is shown with a radius 144 arranged between the upper wall 110 and the perimeter wall 122 such that the upper wall 110 gradually curves into the perimeter wall 122. The radius 144 may be larger or smaller as is necessary for specific packaging constraints.

In addition to the rocker body 104, the rocker arm assembly 100 includes a trunnion body 124 disposed in the pivot bore 120 of each ear 112. As will be discussed in further detail below, the trunnion body 124 defines a mounting bore 126 configured to receive the fastener 78 that couples the rocker arm assembly 100 to the pedestal 76 of the cylinder head 52. A bearing 128 is supported on the trunnion body 124 and disposed in the pivot bore 120 between the trunnion body 124 and the rocker body 104. The bearing 128 facilitates pivoting movement between the rocker body 104 and the trunnion body 124.

As mentioned above and shown in FIG. 2, displacement of the pushrod 72 pivots the rocker arm assembly 100 to actuate the valve 60. To this end, the rocker body 104 engages both the pushrod 72 and the valve 60. The pushrod 72 engages the rocker body 104 near the socket end 108 and the valve engages the rocker body 104 near the pad end 106. The rocker body 104 includes a pad 130 formed on the pad end wall 116 and having a convex pad surface 132 oriented away from the upper wall 110 for engaging the valve stem 64. The rocker body 104 further includes a socket 134 formed on the socket end wall 118 and having a concave socket surface 136 oriented away from the upper wall 110 for engaging the ball end 74 of the pushrod 72.

Referring to FIGS. 6-9, the pad 130 and the socket 134 are shown with the convex pad surface 132 and the concave socket surface 136 opening away from the upper wall 110. In other words, the convex pad surface 132 and the concave socket surface 136 are each generally directed in the same direction as the ears 112 extending from the upper wall 110. The pad 130 protrudes from the pad end wall 116 in a direction away from the socket end 108 thereby increasing a length of the pad 130 in the longitudinal direction. Additionally, the pad 130 may protrude from the pad end wall 116 in a direction toward the socket end 108 increasing the length of the pad 130 in the longitudinal direction further still.

Referring to FIG. 6, the convex pad surface 132 has a generally rectangular shape that protrudes from the perimeter wall 122 away from the upper wall 110. The rectangular shape of the convex pad surface 132 is curved about an axis that is generally parallel with the pivot axis 102 and spaced toward the upper wall 110 from the convex pad surface 132. Shown in FIGS. 7 and 9, the configuration of the convex pad surface 132 is such that the curve is in a longitudinal direction in order to facilitate sliding contact with the valve stem 64 as the rocker body 104 pivots about the pivot axis 102.

Returning to FIG. 6, the socket 134 protrudes from the socket end wall 118 in a direction away from the pad end 106 to increase a size of the socket 134. Additionally, the socket 134 may protrude from the socket end wall 118 in a direction toward the pad end 106 to further increase the size of the socket 134 and align a center of the socket 134 on the perimeter wall 122. Referring again to FIG. 9, the socket 134 has a generally semi-spherical shape, which is formed in the socket end wall 118, and opens away from the upper wall 110. The socket 134 is sized to receive the pushrod 72 such that the ball end 74 is in contact with the concave socket surface 136. In addition to the concave socket surface 136, the socket 134 may further have a lead-in surface 137. The lead-in surface 137 has a diameter that is larger than the ball end 74 of the pushrod 72 and may define an opening to the socket 134. The lead-in surface 137 provides a large opening into which the pushrod 72 may be received during assembly and is generally adjacent to and at least partially surrounding the concave socket surface 136 such that the lead-in surface 137 guides the ball end 74 toward alignment into the concave socket surface 136. The lead-in surface 137 may have a semi-spherical, conical, or otherwise tapering shape suitable to aid alignment and correct assembly of the pushrod 72 and rocker arm assembly 100. The shape of the concave socket surface 136 may be defined as a spherical segment with a relief portion 138 near the upper wall 110, the relief portion 138 defining a lubrication port 140. As will be discussed in further detail below, the lubrication port 140 allows a lubricant to flow into a lubrication passage 142 defined in the rocker body 104.

Figure 8:
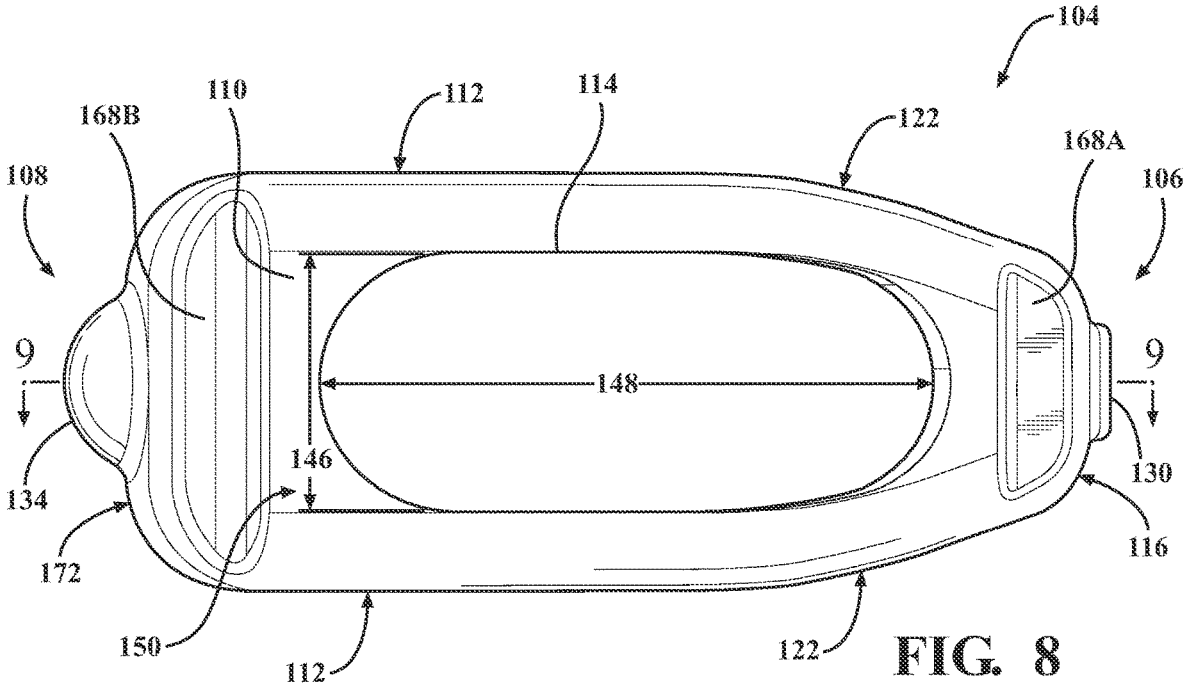
FIG. 8 is a top view of the rocker body of FIG. 6.

Turning now to the top down view of FIG. 8, a top surface 150 of the upper wall 110 is shown. The aperture 114 is shown having a generally oblong shape and extending through the upper wall 110. The aperture 114 further has an aperture width 146 and an aperture length 148. In some instances the aperture width 146 may be the same as the width of the upper wall 110 defined between the radii 144 formed alongside the perimeter wall 122. The aperture length 148 is generally oriented with the longitudinal direction of the rocker arm assembly 100. Longitudinal ends of the aperture 114 may be curved, as shown, giving the aperture 114 an oval shape, or the longitudinal ends may be curved less than is shown so as to define a more rectangular shape of the aperture 114.

In FIG. 6, the bottom-side perspective view of the rocker body 104 shows the pad 130 and socket 134, as well as the ears 112 and perimeter wall 122. A bottom surface 152 of the upper wall 110 is adjacent to and cooperates with the perimeter wall 122 to define a cavity 154 of the rocker body 104. Similar to the aperture 114 discussed above, the cavity 154 may have an oblong shape with a cavity width 156 and a cavity length 158. The cavity width 156 is a lateral measurement between facing surfaces of the ears 112 or perimeter wall 122 and the cavity length 158 is a longitudinal distance between facing surfaces of the socket end wall 118 and the pad end wall 116. Because the rocker arm assembly 100 is subject to large forces from both the valve spring 68 and the pushrod 72, strength of the rocker body 104 is important. One aspect that increases strength is forming the rocker body 104 such that material is located where it is most needed. One example of this is forming the rocker body 104 such that the aperture 114 is smaller than the cavity 154. Specifically, the aperture width 146 is less than the cavity width 156, and the aperture length 148 is less than the cavity length 158. In this way, an undercut region 160 may be formed on the rocker body 104, which is visible in FIGS. 6 and 9. On the pad end 106, the undercut region 160 may include a region at least partially above the pad 130, or between the convex pad surface 132 and the bottom surface 152 of the upper wall 110.

Figure 9:
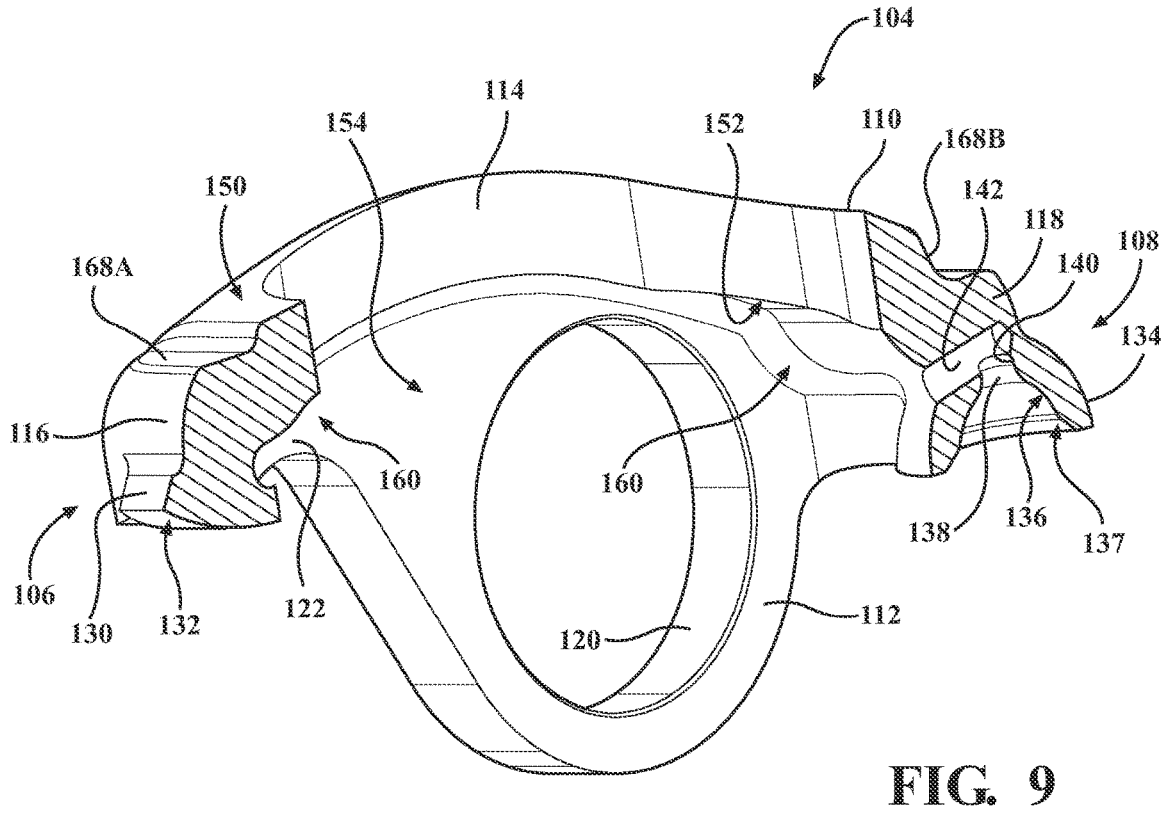
FIG. 9 is a cross-sectional perspective view of the rocker body of FIG. 8 taken along line 9-9.

Further details of the rocker body 104 are shown in FIG. 9. Specifically, details of the socket end 108 and the socket 134. Here, the lubrication port 140 and lubrication passage 142 are shown in cross-section to illustrate the path that a lubricant (such as oil, grease, etc.) can follow. As discussed above, the forces acting on the rocker arm assembly 100 can be very large, especially as engine speed and power output are increased. For this reason, lubricant is provided to reduce friction and wear associated with sliding contact between several components. Here, lubricant may be supplied through a lumen (not shown) defined in the pushrod 72. When the pushrod 72 is received inserted into the socket 134, the ball end 74 engages the concave socket surface 136 such that lubricant flowing out of the pushrod 72 is forced into the lubrication port 140, while a smaller amount of lubricant is pushed between the ball end 74 and the concave socket surface 136.

Lubricant that has entered the lubrication port 140 from the pushrod 72 then flows into the lubrication passage 142. The lubrication passage 142 extends from the lubrication port 140 to the cavity 154, where lubricant exits the lubrication passage 142 to further lubricate the pad 130 and the bearing 128, among other functions. The implementation of the lubrication passage 142 shown here is formed as a blind hole extending from generally near the undercut region 160 at the socket end 108 of the cavity 154, into a portion of the socket end wall 118, and intersects with the lubrication port 140 in the socket 134. In other implementations, the lubrication passage 142 may be one or more passages that intersect with the lubrication port 140 or each other. Further, either or both of the lubrication port 140 and the lubrication passage 142 may be formed during manufacturing as through holes and subsequently capped on one side.

Turning now to FIG. 7, several measurements of portions of the rocker body 104 are shown. Specifically, the measurements show the arrangement and relative spacing of particular elements, as will be discussed. When viewed from the side, i.e. with the pivot axis 102 perpendicular to the page, an uppermost surface of the upper wall 110 is spaced at a first height 162 from the pivot axis 102 (shown here as a point positioned in the center of the pivot bore 120). In this embodiment, the uppermost surface is the top surface 150 of the upper wall 110 and, as such, the first height 162 is a vertical measurement between the top surface 150 and the pivot axis 102. Similarly, the pad 130 and the socket 134 are each spaced at respective heights from the pivot axis 102. Specifically, the pad 130 is spaced at a pad height 164 from the pivot axis 102, which is a vertical measurement between the convex pad surface 132 and the pivot axis 102. The socket 134 is spaced at a socket height 166 from the pivot axis 102, which is a vertical measurement between the opening of the socket 134 and the pivot axis 102.

The arrangement of the pad 130 and the socket 134 can be described relative to the first height 162 of the upper wall 110. The pad height 164 is less than the first height 162, and it follows that the pad 130 is arranged at a height that is between the upper wall 110 and the pivot axis 102. Likewise, the socket height 166 is less than the first height 162, and it also follows that the socket 134 is arranged at a height that is between the upper wall 110 and the pivot axis 102. While the pad height 164 and the socket height 166 of the embodiment shown here are approximately equal, the rocker body 104 could be configured with the pad height 164 greater than the socket height 166, or with the socket height 166 greater than the pad height 164 as may be necessary to best suit the intended application.

The top of the rocker body 104 is best shown in FIGS. 2, 3, 5, and 8, where a rib 168 is defined on the top surface 150 of the upper wall 110. The rib 168 is formed into the upper wall 110 as a localized area of reduced thickness. The rib 168 extends across the upper wall 110 in a direction generally parallel to the pivot axis 102. As in the embodiment illustrated throughout the figures, the rib may be further defined as a first rib 168A and a second rib 168B. The first rib 168A is positioned on the top surface 150 of the upper wall 110 between the pad end 106 and the pivot axis 102. The second rib 168B is positioned on the top surface 150 of the upper wall 110 between the socket end 108 and the pivot axis 102. Each rib 168A, 168B includes two sub-surfaces that are generally perpendicular to each other and connected with a radius therebetween. The sub-surfaces are also at an angle to the top surface 150 such that the ribs 168A, 168B are recessed into the upper wall 110.

Several methods may be employed to form the rocker body 104 having the features described herein. For example, one embodiment of the rocker body 104 may be manufactured with a stamping process using a tool (not shown), which includes a die and a punch. Here, the die forms the outside surfaces (e.g. the top surface 150, and ribs 168A, 168B) while the punch forms the inside surfaces (e.g. the bottom surface 152, and the cavity 154). The punch and die are brought together with raw material stock therebetween, thereby displacing the raw material into the shape of the rocker body 104. Relative to the orientation in which the finished rocker body 104 is installed for operation in an engine, the punch forms the features of the rocker body 104 that are oriented toward the cylinder head 52, while the die forms the features that are oriented away from the cylinder head 52. Alternative manufacturing processes may similarly be employed, for example additive processes such as casting, forging, 3D printing, and the like, and alternatively subtractive processes where raw material is removed from a billet via milling, drilling, etc.

Additional operations may be required to form other features of the rocker body 104, such as punching the pivot bore 120 in the ears 112. These operations may be performed before or after the aforementioned stamping process as may be necessary. After the rocker body 104 is formed, the pad 130 and the socket 134 may be formed via a coining process that compresses the material on the respective pad end wall 116 and socket end wall 118. Furthermore, the lubrication port 140 and lubrication passage 142 may be formed via a drilling operation, accessing the lubrication port 140 through the socket 134 and accessing the lubrication passage 142 through the cavity 154. The lubrication port 140 may be formed before the lubrication passage 142 or vice versa.

Figure 10:
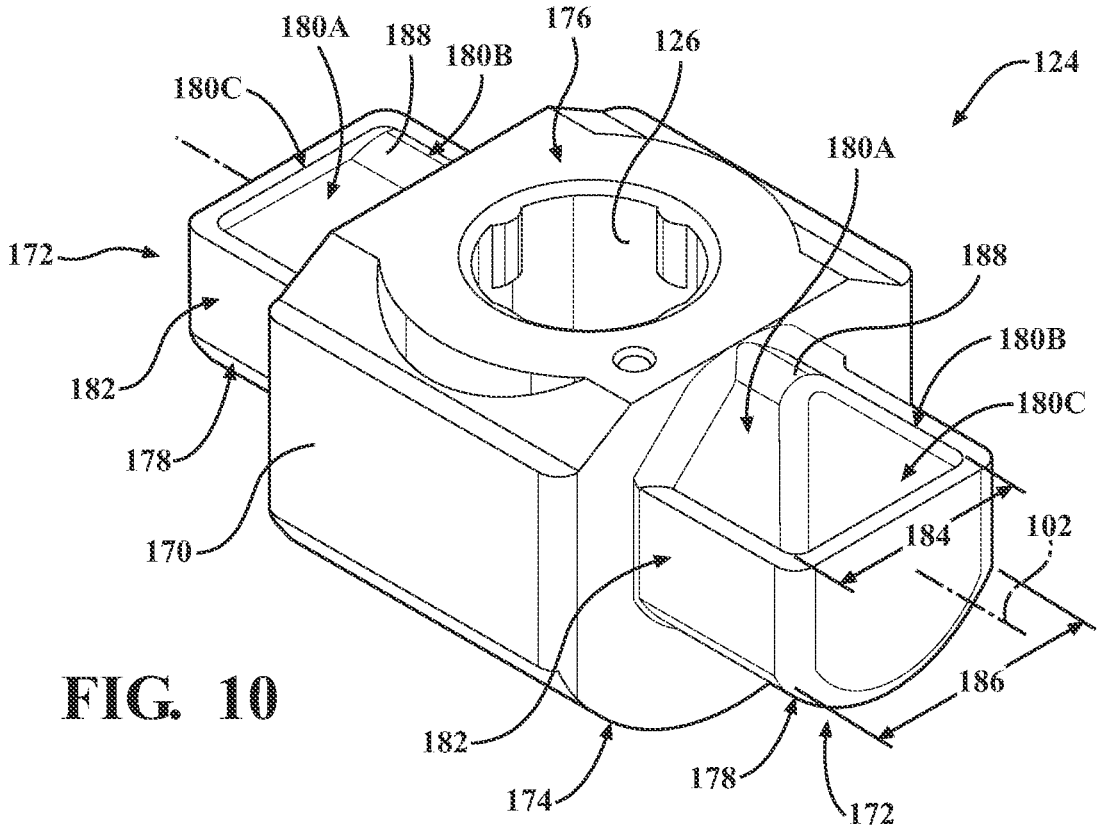
FIG. 10 is a perspective view of the trunnion body of FIG. 5.
Figure 11:
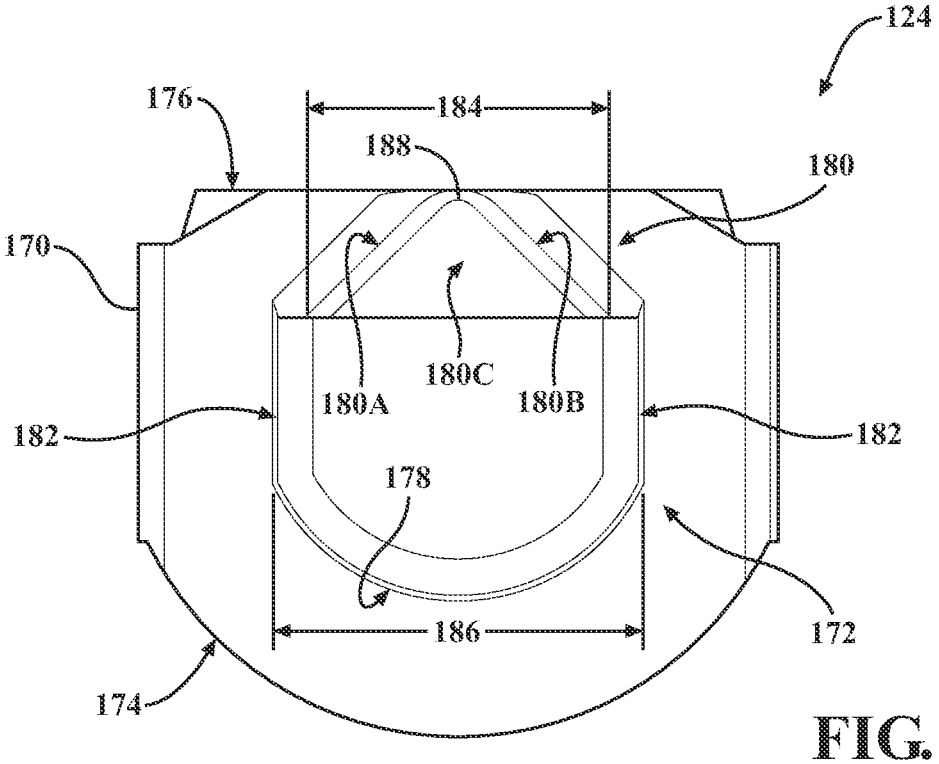
FIG. 11 is a side view of the trunnion body of FIG. 10.
Figure 13:
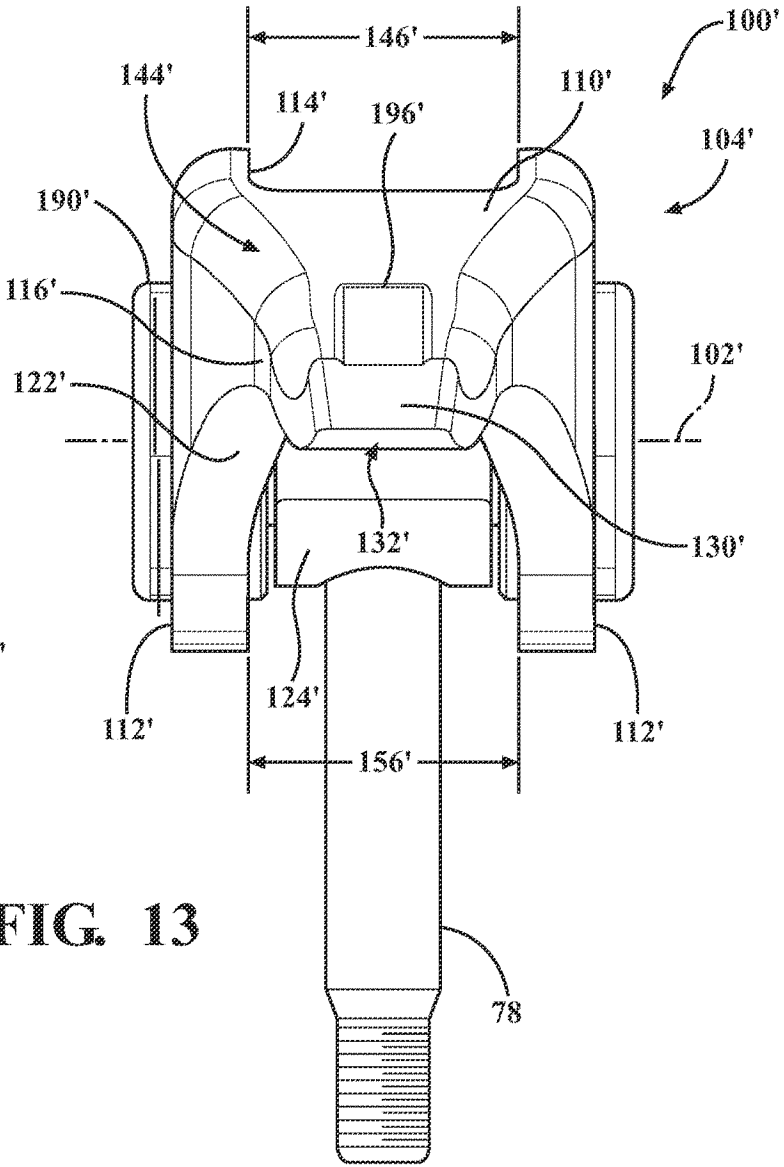
FIG. 13 is a front view of the rocker arm assembly of FIG. 12 including a rocker body and a trunnion body.
Figure 12:
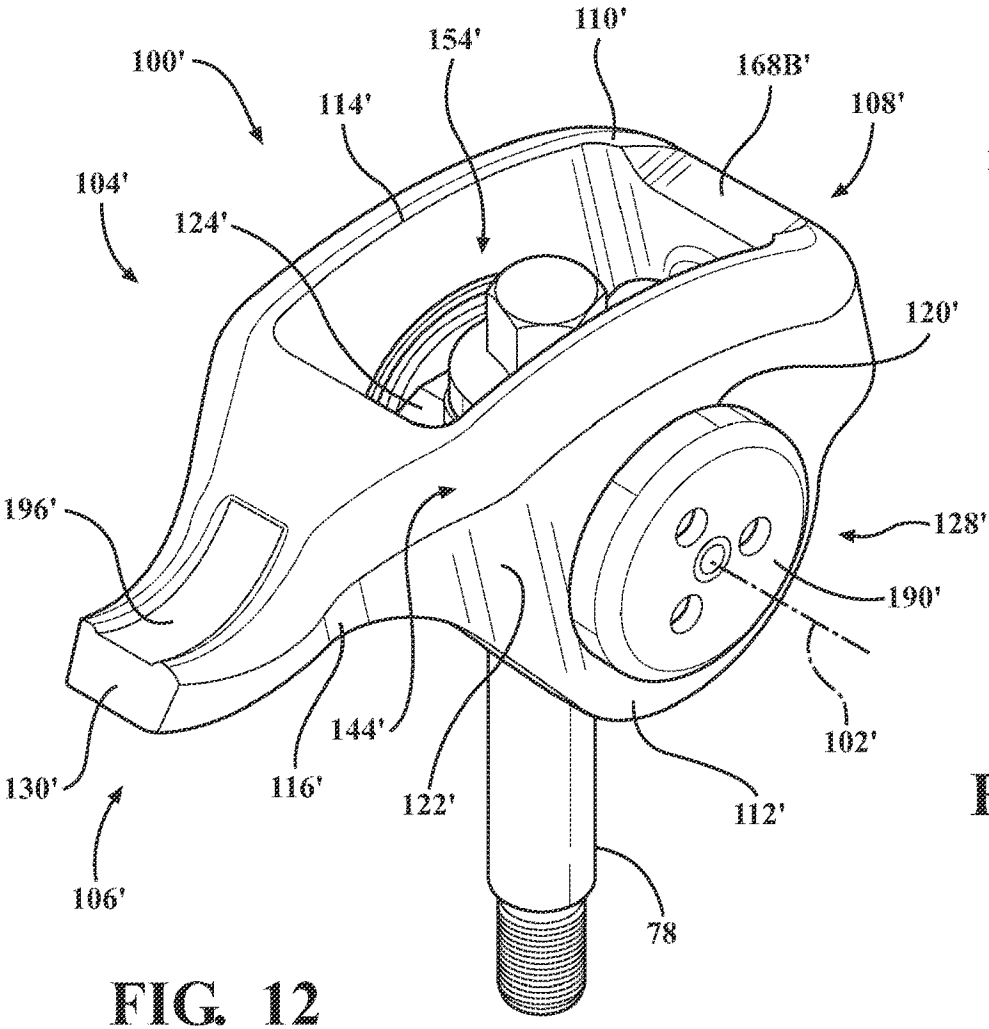
FIG. 12 is a perspective view of a second embodiment of a rocker arm assembly and a fastener.

Turning now to FIGS. 10 and 11, the trunnion body 124 is shown in a perspective view and a side view. In addition to the aforementioned mounting bore 126, the trunnion body 124 includes a mounting segment 170 and two trunnion arms 172 coupled thereto. Each of the trunnion arms 172 has a non-circular profile and protrudes from an opposing side of the mounting segment 170 in a direction generally parallel with the pivot axis 102 of the rocker arm assembly 100. The mounting segment 170 has a pedestal engaging face 174 and a fastener boss 176 arranged opposite the pedestal engaging face 174. The pedestal engaging face 174 may be flat or curved, as the case may be. In some embodiments a rocker stand (not shown) may be arranged on top of the pedestal 76 to receive the pedestal engaging face 174. Here, the pedestal engaging face 174 is configured to engage the cylinder head 52 on a pedestal 76 having a curved face. The mounting bore 126 is defined in the mounting segment 170 and extends between the fastener boss 176 and the pedestal engaging face 174. The fastener 78 is disposed in the mounting bore 126 to clamp the trunnion body 124 to the pedestal 76.

Because the forces acting on the rocker arm assembly 100 can be quite large, the bearing 128 is used to reduce friction between the rocker body 104 and the trunnion body 124. The bearing 128 is supported by the trunnion arms 172 to facilitate pivoting movement between the rocker body 104 and the trunnion body 124. The forces acting on the rocker arm assembly 100 however do not act on all sides of the bearing 128 equally, that is to say that the forces are generally oriented away from the cylinder head 52. As such, the non-circular profile of the trunnion arms 172 includes a thrust surface 178 and an anti-thrust surface 180. The thrust surface 178 is configured to receive a majority of the forces acting between the rocker body 104 and the trunnion body 124 and is therefore arranged facing toward the cylinder head 52. As such, the anti-thrust surface 180 receives a smaller proportion of these forces and is arranged facing away from the cylinder head 52. A third surface 182 may be positioned between the thrust surface 178 and the anti-thrust surface 180. The third surface 182 does not contact the bearing 128 and may be flat or curved.

The thrust surface 178 is curved to increase the engagement between the trunnion arm 172 and the bearing 128 to support relatively larger forces and the anti-thrust surface 180 is angled to reduce contact between the trunnion arm 172 and the bearing 128. The anti-thrust surface 180 includes two faces 180A, 180B that meet at a vertex 188 spaced from the pivot axis 102. The vertex 188 may have a slight radius that connects a first face 180A to a second face 180B. Contact of the anti-thrust surface 180 and the bearing 128 may be further reduced by angling an outer face 180C inward toward the mounting segment 170 such that the vertex 188 of the anti-thrust surface 180 has a length less than a length of the thrust surface 178 of the trunnion arm 172.

In addition to being angled, the anti-thrust surface 180 may also be smaller than the thrust surface 178. The anti-thrust surface 180 has a width 184 measured at a widest point and in a direction perpendicular to the pivot axis 102. The thrust surface 178 has a trunnion diameter 186 measured as the diameter of a circle centered on the pivot axis 102 and aligned with the curve of the thrust surface 178. The width 184 of the anti-thrust surface 180 may be less than the trunnion diameter 186 of the thrust surface 178.

Referring again to FIGS. 2-5, the rocker arm assembly 100 the bearing 128. In one configuration, the bearing 128 may be realized as first and second bearings, shown generally in FIG. 4. The first and second bearings 128 are each supported for rotation on the trunnion body 124 and disposed in each of the pivot bores 120. In the embodiment illustrated throughout the FIGS. 7-8, the bearing 128 may be realized as a roller bearing assembly. As shown in the partially exploded view of FIG. 5, the second bearing 128 may include an outer race 190, an inner race 192, and a plurality of rollers 194. The outer race 190 is adapted to engage the pivot bore 120 and the inner race 192 is adapted to engage either of the trunnion arms 172. The plurality of rollers 194 are arranged between the outer race 190 and the inner race 192. The rollers 194 reduce friction and help distribute load between the inner race 192 and the outer race 190 during operation.

Other configurations of the bearing 128 are contemplated by the present disclosure. For example, the first and second bearings 128 may include the rollers 194 shown having a cylindrical configuration or may be a ball bearing that includes rollers having a spherical configuration (not shown). In another alternative, the bearing 128 may be realized as hydrodynamic journal bearings (not shown), which are rotatably supported on the trunnion arms 172.

Referring now to FIGS. 12-17, a second embodiment of the rocker arm assembly is shown. In many respects, the rocker arm assembly 100', may be similar to that previously described with like numerals (plus a prime symbol e.g. 100') corresponding to like components, and any disclosure common to the corresponding components may be considered omitted in the interest of brevity should not be construed as limiting. The second embodiment of the rocker arm assembly 100' comprises a rocker body 104' having a pad end 106' and a socket end 108'. The socket end 108' is spaced in a longitudinal direction relative to the pad end 106' such that the socket end 108' and the pad end 106' are on opposite sides of the pivot axis 102'. The arrangement of the pad end 106' and the socket end 108' across the pivot axis 102' is such that movement of one end results in coordinated movement of the other, e.g. as the socket end 108' moves in an upward direction the pad end 106' moves in a downward direction, and vice versa.

The rocker body 104' generally includes an upper wall 110' and two ears 112'. The upper wall 110' is arranged above the pivot axis 102' and defines an aperture 114' extending therethrough. The ears 112' each extend downwardly from laterally opposing sides of the upper wall 110' when the rocker arm assembly 100' is oriented in an installed position. Each ear 112' defines a pivot bore 120' that is coaxial with the pivot axis 102'. Each pivot bore 120' extends through the respective ear 112' and shares a common diameter with the pivot bore 120' on the opposing ear 112'.

The rocker body 104' may further include a pad end wall portion 116' and a socket end wall portion 118' arranged as the respective pad end 106' and socket end 108'. The pad end wall portion 116' and the socket end wall portion 118' each extend downwardly from longitudinally opposing ends of the upper wall 110'. The pad end wall portion 116' and the socket end wall portion 118' may cooperate with the ears 112' to define a perimeter wall 122'. As with the ears 112' and end walls 116', 118', the perimeter wall 122' extends downwardly from a periphery of the upper wall 110'. The upper wall 110' and the perimeter wall 122' may be integrally formed with various general shapes. Here, the upper wall 110' is generally rectangular and the perimeter wall 122' is formed on each of the four sides. Furthermore, the delineation between the upper wall 110' and the perimeter wall 122' may vary. For example, the rocker body 104' is shown with a radius 144 arranged between the upper wall 110' and the perimeter wall 122' such that the upper wall 110' gradually curves into the perimeter wall 122'. The radius 144' may be larger or smaller as is necessary for specific packaging constraints.

The rocker body 104' includes a pad 130' formed on the pad end wall portion 116' and having a convex pad surface 132' oriented away from the upper wall 110' for engaging the valve stem 64. The rocker body 104' further includes a socket 134' formed on the socket end wall portion 118' and having a concave socket surface 136' oriented away from the upper wall 110' for engaging the ball end 74 of the pushrod 72. The pad 130' protrudes from the pad end wall 116' in a direction away from the socket end 108' thereby increasing a length of the pad 130' in the longitudinal direction. Furthermore, the pad 130' tapers along its length to a width that is less than the rocker body 104'.

Figure 16:
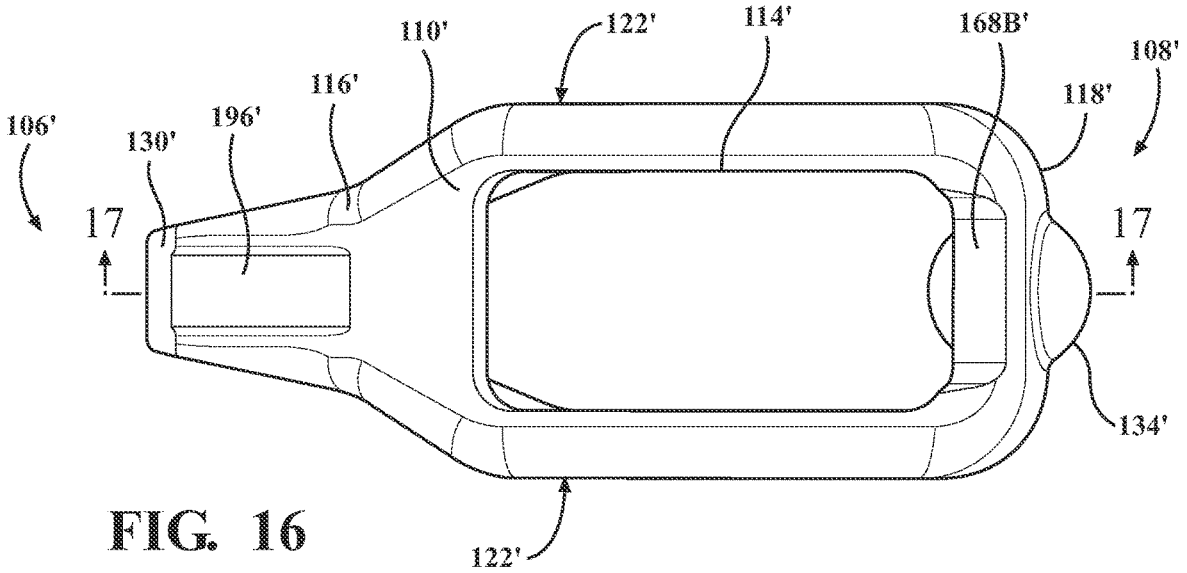
FIG. 16 is a top view of the rocker body of FIG. 14.

Referring to FIGS. 14-16, the convex pad surface 132' may have a generally elongated shape that protrudes from the pad end wall portion 116'. The elongated shape of the convex pad surface 132' is curved about an axis that is generally parallel with the pivot axis 102' and spaced toward the upper wall 110' from the convex pad surface 132'. The convex pad surface 132' and the concave socket surface 136' are each generally directed in the same direction as the ears 112' extending from the upper wall 110'.

Figure 17:
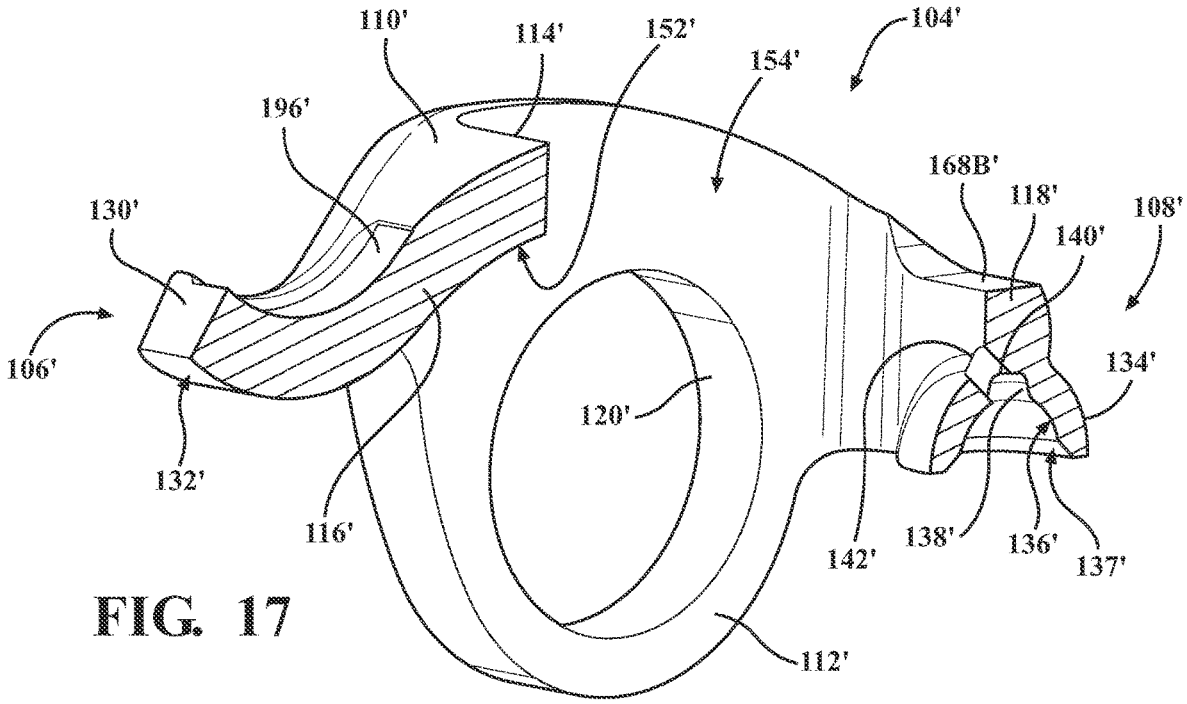
FIG. 17 is a cross-sectional view of the rocker body of FIG. 16 taken along line 17-17.

Shown in FIGS. 15 and 17, the configuration of the convex pad surface 132' is such that the curve is in a longitudinal direction in order to facilitate sliding contact with the valve stem 64 as the rocker body 104' pivots about the pivot axis 102'. Specifically, in FIG. 14, the bottom-side perspective view of the rocker body 104' shows the convex pad surface 132' and the socket 134', as well as the ears 112' and perimeter wall 122'. A bottom surface 152' of the upper wall 110' is adjacent to and cooperates with the perimeter wall 122', which may define a cavity 154' of the rocker body 104'. The bottom surface 152' of the upper wall 110' and the convex pad surface 132' may be adjacent to each other such that the bottom surface 152' and the convex pad surface 132' are continuous with each other. The bottom surface 152' of the upper wall 110' curves downward into the pad end wall portion 116' and joins the convex pad surface 132' as the convex pad surface 132' begins to curve upward.

Referring to FIG. 17, details of the socket end 108' and the socket 134' are shown. Here, the lubrication port 140' and lubrication passage 142' are shown in cross-section to illustrate the path that a lubricant (such as oil, grease, etc.) can follow. Similar to above, lubricant may be supplied through a lumen (not shown) defined in the pushrod 72. When the pushrod 72 is received inserted into the socket 134', the ball end 74 engages the concave socket surface 136' such that lubricant flowing out of the pushrod 72 is forced into the lubrication port 140', while a smaller amount of lubricant is pushed between the ball end 74 and the concave socket surface 136'.

Lubricant that has entered the lubrication port 140' from the pushrod 72 then flows into the lubrication passage 142'. The lubrication passage 142' extends from the lubrication port 140' to the cavity 154', where lubricant exits the lubrication passage 142' to further lubricate the pad 130' and the bearing 128', among other functions.

The pad end wall portion 116' and the pad 130' may include a channel 196' formed on an upward facing surface generally positioned along a longitudinal centerline of the rocker body 104'. The channel 196' is configured to collect lubricant that may be splashed onto the rocker body 104' and funnel the collected lubricant to the valve stem 64. By depositing the lubricant on the top of the valve stem 64, friction and wear due to contact between the convex pad surface 132' and the valve stem 64 may be reduced. The size and shape of the channel 196' may vary according to the amount of lubricant expected to be splashed as well as the lubrication needs of the valve stem 64. As shown here, the channel 196' has a generally flat surface, however the channel 196' may include additional features or surfaces usable during the manufacturing process for fixturing and/or alignment.

Several examples have been discussed in the foregoing description. However, the examples discussed herein are not intended to be exhaustive or limiting to any particular form. The terminology that has been used is intended to be in the nature of words of description rather than of limitation. Many modifications and variations are possible in light of the above teachings and may be practiced otherwise than as specifically described.

What is claimed is:

1. A rocker arm assembly comprising:

a rocker body including:

a socket end and a pad end longitudinally spaced from each other so as to be on opposite sides of a pivot axis;

an upper wall arranged above said pivot axis, said upper wall defining an aperture;

two ears respectively extending from opposing sides of said upper wall, each ear defining a pivot bore coaxially aligned with said pivot axis;

a pad end wall portion extending from said upper wall and said two ears at said pad end;

a socket end wall portion extending from said upper wall and said two ears at said socket end;

a pad formed on said pad end wall portion, said pad including a convex pad surface oriented away from said upper wall so as to engage a valve stem; and a socket formed on said socket end wall portion, said socket including a concave socket surface opening away from said upper wall so as to engage a pushrod;

a trunnion body disposed between said two ears so as to extend through said pivot bores, said trunnion body defining a mounting bore configured for receiving a fastener; and a bearing disposed in each pivot bore, said bearings supported on said trunnion body so as to facilitate pivoting movement between said rocker body and said trunnion body, wherein said pad end wall portion, said socket end wall portion, and said two ears cooperate so as to form a perimeter wall defining a cavity, wherein said aperture has an aperture width and an aperture length, and said cavity has a cavity width and a cavity length, and wherein said cavity width is greater than said aperture width, and said cavity length is greater than said aperture length.

2. The rocker arm assembly of claim 1, wherein said rocker body further includes a lubrication passage defined between said socket and said cavity.

3. The rocker arm assembly of claim 1, wherein said upper wall and said perimeter wall are integrally connected to each other via a radius.

4. The rocker arm assembly of claim 1, wherein said pad protrudes from said pad end wall portion away from said socket end.

5. The rocker arm assembly of claim 1, wherein said socket protrudes from said socket end wall portion away from said pad end.

6. The rocker arm assembly of claim 1, wherein said two ears extend downwardly from said upper wall in an installed position of the rocker arm assembly.

7. The rocker arm assembly of claim 1, wherein said upper wall has a thickness of at least 4 mm and at most 6 mm.

8. The rocker arm assembly of claim 1, wherein an uppermost surface of said upper wall is spaced from said pivot axis at a first height and said pad is spaced from said pivot axis at a second height, wherein said second height is less than said first height.

9. The rocker arm assembly of claim 1, wherein an uppermost surface of said upper wall is spaced from said pivot axis at a first height and said socket is spaced from said pivot axis at a second height, wherein said second height is less than said first height.

10. The rocker arm assembly of claim 1, wherein said rocker body further includes a rib defined on a top surface of said upper wall, said rib extending across said upper wall in a direction parallel to said pivot axis.

11. The rocker arm assembly of claim 10, wherein said rib is positioned between said pad end and said pivot axis.

12. The rocker arm assembly of claim 10, wherein said rib is positioned between said socket end and said pivot axis.

13. The rocker arm assembly of claim 1, wherein each bearing includes a plurality of rolling elements disposed between an inner race and an outer race.

14. The rocker arm assembly of claim 1, wherein said trunnion body includes two trunnion arms respectively extending from opposing sides of a mounting segment, wherein said mounting bore is defined in said mounting segment, and wherein each trunnion arm has a non-circular profile.

15. The rocker arm assembly of claim 14, wherein said non-circular profile includes a curved thrust surface and an angled anti-thrust surface.

16. The rocker arm assembly of claim 15, wherein said curved thrust surface has a trunnion arm diameter, and said angled anti-thrust surface has an anti-thrust width, and wherein said anti-thrust width is less than said trunnion arm diameter.

17. The rocker arm assembly of claim 15, wherein a third surface is positioned between said curved thrust surface and said angled anti-thrust surface of each trunnion arm.

18. The rocker arm assembly of claim 1, wherein said rocker body is formed via stamping.

* * * * *